United States Patent [19]

McCabe

[11] 4,011,080

[45] Mar. 8, 1977

[54] ELECTROPHOTOGRAPHIC ELEMENTS COMPRISING POLYSILICIC ACID-CROSSLINKED CONDUCTIVE POLYMERS

[75] Inventor: John Murray McCabe, Pittsford, N.Y.

[73] Assignee: Eastman Kodak Company, Rochester, N.Y.

[22] Filed: Aug. 30, 1974

[21] Appl. No.: 502,259

Related U.S. Application Data

[63] Continuation-in-part of Ser. No. 447,421, March 1, 1974, abandoned.

[52] U.S. Cl. ..... 96/1.5; 96/87 A; 252/500; 427/74; 428/446

[51] Int. Cl.[2] ..... G03G 5/04

[58] Field of Search ..... 96/1.5, 87 A; 117/218; 252/500; 427/74; 428/446

[56] References Cited

UNITED STATES PATENTS

| | | | |
|---|---|---|---|
| 3,544,318 | 12/1970 | Boothe et al. | 96/1.5 |
| 3,640,766 | 2/1972 | Jursich et al. | 96/1.5 |
| 3,776,983 | 12/1973 | Iovine et al. | 96/1.5 |
| 3,795,516 | 3/1974 | Stahr et al. | 96/1.5 |
| 3,825,424 | 7/1974 | Gracia et al. | 96/1.8 |

FOREIGN PATENTS OR APPLICATIONS

| | | | |
|---|---|---|---|
| 581,751 | 10/1946 | United Kingdom | 96/87 A |
| 878,258 | 9/1961 | United Kingdom | 96/87 A |

*Primary Examiner*—David Klein
*Assistant Examiner*—Judson R. Hightower
*Attorney, Agent, or Firm*—A. H. Rosenstein

[57] ABSTRACT

A method of overcoating a conductive polymer support with an aqueous-based polymer coating comprises crosslinking the conductive polymer with hydrolyzed tetraethyl orthosilicate prior to overcoating. An electrophotographic element can be prepared by coating a support with a conductive layer comprising a conductive polymer crosslinked with hydrolyzed tetraethyl orthosilicate (polysilicic acid) and overcoating with an aqueous-based layer of an electrically insulating polymer containing a photoconductor.

24 Claims, No Drawings

ELECTROPHOTOGRAPHIC ELEMENTS COMPRISING POLYSILICIC ACID-CROSSLINKED CONDUCTIVE POLYMERS

This application is a continuation-in-part of U.S. Ser. No. 447,421, filed Mar. 1, 1974 now abandoned.

This invention is concerned with a method of overcoating a conductive polymer with an aqueous-based polymeric solution or dispersion without leaching of materials from one layer to another. In a preferred embodiment, it relates to an electrophotographic element comprising a support with a conductive layer comprising a conductive polymer which is crosslinked with tetraethyl orthosilicate and overcoated with an insulating layer containing a photoconductor.

The use of solvent-based compositions in applying insulating overcoats for conductive layers in the electrophotographic field and the photographic field is well known. It has been desired, however, for economic, physiological and ecological purposes, to use aqueous coating solutions to apply the insulating overcoat. For the same reasons, the use of aqueous coating solutions to apply conductive resin layers to serve as antistatic layers for photographic elements such as silver halide emulsion elements, as conductive layers in electrophotographic elements, either in the light-sensitive elements or in a receiver sheet, or as conductive layers in electrographic layers used in facsimile recording layers has been the object of research.

Aqueous-based materials of this type, however, are inherently water-leachable which precludes the overcoating of such conductive layers with water-based layers which are designed to be substantially non-conductive.

The use of polysilicic acid in crosslinking poly(vinyl acetate) and poly(vinyl butyrate) is desribed in U.S. Pat. No. 2,440,771.

The use of crosslinking agents to decrease the migratory action of leachable materials has been proposed but crosslinking agents, in general, are toxic, form cross-linked polymers which are highly-colored and are chemically active which may undesirably affect the sensitometric characteristics of photographic elements in which they are used.

Accordingly, it is an object of this invention to provide a method of coating a layer of conductive polymer with a water-soluble or dispersible coating without substantial leaching of materials from one layer to the other.

It is another object of this invention to provide a conductive layer topcoated with a water-based coating.

It is still another object of this invention to provide a method of preparing an electrophotographic element comprising a conductive layer and an overcoat layer comprising an insulating polymer and a photoconductor.

It is a further object of this invention to provide a method of preparing a water-soluble, non-conductive overcoat layer for a conductive layer in an electrophotographic element.

It is a still further object of this invention to provide an electrophotographic element comprising a conductive layer with a non-conductive overcoat.

It is still another object of this invention to provide a conductive polymeric layer to be used as an antistatic layer for silver halide emulsion elements.

These objects of the present invention are accomplished by crosslinking the conductive polymer with hydrolyzed tetraethyl orthosilicate prior to overcoating with a water-soluble or dispersible coating.

The element of this invention comprises a support having thereon a conductive layer comprising a conductive polymer crosslinked with hydrolyzed tetraethyl orthosilicate (polysilicic acid), said conductive layer having coated thereon an aqueous-based coating. In the preferred embodiment, the element is an electrophotographic element wherein the overcoat layer comprises an insulating polymer containing a photoconductor. In another embodiment, the element is a photographic element comprising an antistatic layer of a conductive polymer having coated thereon a silver halide emulsion layer. The hydrolyzed tetraethyl orthosilicate spontaneously crosslinks the conductive polymer during conventional drying steps to form a conductive layer that is non-photoactive, non-tacky and has high resistance to abrasion. Water-based electrically insulating layers can be coated directly upon the crosslinked polymers without any significant loss of the electrical characteristics of either layer.

The term "aqueous-based coating" as used throughout the specification and claims is understood to include coating compositions which are entirely soluble in water and form water solutions, coatings which are dispersible in water and form dispersions, as well as coating solutions or dispersion containing water which also contain some solvents. The term also includes layers or coatings which may or may not be water soluble or water dispersible in dryed form but which are applied as coatings or layers in a solution or dispersion containing water.

The conductive polymer which is crosslinked with the hydrolyzed tetraethyl orthosilicate can be any electrically conductive polymer having an electrical resistivity of $1 \times 10^{10}$ ohm/sq. or lower and containing an -OH or $$-\underset{\underset{O}{\|}}{C}-$$

crosslinkable group. The polymers are water-soluble and may be coated out of aqueous solutions. Electrical resistivity is determined at the temperature and relative humidity described in ASTM D257.

Examples of useful electrically conductive, water-soluble polymers containing OH or $$-\underset{\underset{O}{\|}}{C}- \text{ groups}$$

are (1) polymers comprising at least 90% monomers having the formula:

$$(CH_2{=}CH{-}CH_2)_2N^+ \begin{matrix} R \\ R' \end{matrix} \quad A^-$$

where R is alkyl, R′ is R or β-propionamido and $A^-$ is an anion; (2) the reaction product of β-hydroxyalkylmethacrylate and $P_2O_5$; and (3) polymers having the formula:

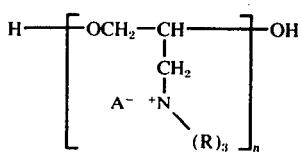

where each R is independently lower alkyl and $A^-$ is as described above and *n* is an integer of from 5 to 2000.

One preferred group of conductive polymers especially useful herein are polymers comprising at least 90% monomers having the formula:

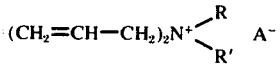

where R is alkyl containing 1 to 18 carbon atoms, such as methyl, ethyl, butyl, octyl, decyl, and the like and R′ is R or

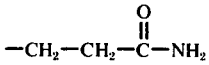

and A is an anion such as Cl, Br, I, OH, $HSO_4$, $H_2PO_4$ and the like. If R′ is an alkyl group the polymer units contain additional units containing the

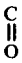

or OH groups to be crosslinked. Any copolymerizable monomer which contains

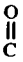

or OH groups may be used for the remaining 10% of the polymer. Examples of monomers useful are acrylamide, diacetone acrylamide, N-vinyl pyrrolidinone and N-methylolacrylamide. Generally it is preferred that the copolymerizable compound be represented by the general formula:

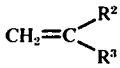

wherein $R^2$ is a member selected from the group consisting of H, halogen such as Cl or Br, alkyl containing from 1 to 4 carbon atoms such as methyl, ethyl, propyl and isobutyl and $R^3$ and wherein $R^3$ is selected from the group consisting aryl and alkaryl and radicals represented by the formulas

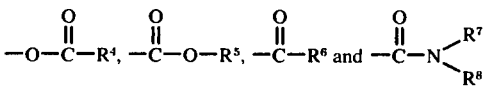

wherein $R^4$ and $R^5$ are alkyl, cycloalkyl, or alkoxyalkyl; $R^6$ is $R^4$ or aryl and $R^7$ and $R^8$ are each independently each alkyl, cycloalkyl, aryl, aralkyl, alkaryl, or alkoxyalkyl.

The monomers having the formula

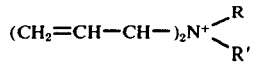

undergo cyclization during conventional free radical polymerization to form piperidinium rings. The preferred copolymers useful herein are

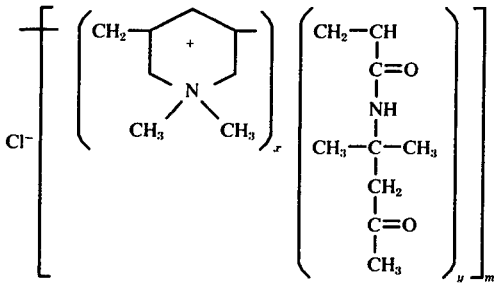

wherein *x* is 90 to 50 mole percent, *y* is 10 to 50 mole percent and *m* is at least 2; and poly[N-methyl-N-(β-propionamide)-3,5-methylene piperidinium chloride].

Examples of these preferred conductive polymers and methods of preparation thereof are described in U.S. Pat. No. 3,544,318, issued Dec. 1, 1970.

A second preferred conductive polymer comprises the reaction product of polyhydroxyethylmethacrylate with $P_2O_5$. The polymers are prepared by reacting $P_2O_5$ with 2-hydroxy ethylmethacrylate and polymerizing in a conventional manner.

Another preferred conductive polymer useful herein has the formula:

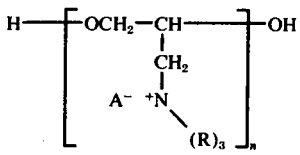

where each R is independently lower alkyl such as methyl, ethyl, propyl and butyl, containing from 1 to 8 carbon atoms, and A is an anion such as Cl, and n is at least 2. Examples of these polymers and the preparation thereof are disclosed in U.S. Pat. No. 3,640,766, issued Feb. 8, 1972.

The conductive polymer is merely mixed with the tetraethyl orthosilicate and dried at temperatures of from about room temperature to 110° C or higher for from a minute to about 24 hours to affect the crosslinking. It has been found that lower temperatures are needed if the drying time is longer and higher temperatures are required to dry if the drying time is short.

Hydrolyzed tetraethyl orthosilicate can be prepared by stirring about 2 parts by weight of tetraethyl orthosilicate with about 1 part by weight of 0.1 normal hydrochloric acid. The temperature rises spontaneously to a maximum of about 60° C within about 5 minutes. Stirring is discontinued and the solution is permitted to stand until used.

The amount of water typically used in the hydrolysis of the ethylsilicate is such that, as the ester progressively hydrolyzes and condenses into a polymer in the presence of suitable solvents, a single solution phase is maintained throughout the process. For example, the amount of water for the hydrolysis of the ethylsilicate can be about 1 part by volume to about 5 parts by volume ethylsilicate but considerably more water may be used. In a preferred embodiment, at least 20 percent by weight of water is used, based on the amount of ethylsilicate. From 20 percent to 100 percent by weight of water based on the amount of ethylsilicate is preferred.

A relatively high concentration of a hydrolysis catalyst is desirable for the hydrolysis of tetraethyl orthosilicate when an efficient common solvent for tetraethyl orthosilicate and the hydrolysis products is not present. This accelerates dissolution and prevents precipitation of silicic acid ($SiO_2 . xH_2O$) due to a high degree of local hydrolysis and polymerization. For this reason, it is convenient to use 0.1 normal hydrochloric acid as the source of both water and catalyst. However, with efficient agitation, 0.01 normal hydrochloric acid may be used and, with an efficient common solvent present, such as ethanol, the reaction proceeds satisfactorily without the use of catalyst. Among the catalysts suitable for this hydrolysis reaction are the mineral acids, such as, hydrochloric, phosphoric, and sulfuric acid, and non-volatile organic acids, such as oxalic and maleic or even weaker or more volatile organic acids, such as acetic and formic acids. In a preferred embodiment, ethylsilicate hydrolyzed with 20 to 75% by weight thereof of water is used.

The proportion of conductive polymer to hydrolyzed tetraethyl orthosilicate used may be varied widely. Generally, the weight ratio of polymer to hydrolyzed tetraethyl orthosilicate is from 1:2 to about 9:1. In preferred embodiments, the weight ratio of conductive polymer described in U.S. Pat. No. 3,544,318 to hydrolyzed tetraethyl orthosilicate is from 1:2 to 2:1. The weight ratio of the conductive polymer, poly-2-methacroyloxyethyl phosphoric acid, to hydrolyzed tetraethyl orthosilicate is from 2:1 to 9:1, and the weight ratio of the conductive polymer described in U.S. Pat. No. 3,640,766 to hydrolyzed tetraethyl orthosilicate is from 2:1 to 9:1.

Various supports may be coated with the crosslinkable conductive polymers and hydrolyzed tetraethyl orthosilicate of this invention. Glass may be employed, as may be metals, such as aluminum, copper, zinc and tin. Conventional film bases such as cellulose acetate, cellulose nitrate, cellulose acetatebutyrate, poly(ethylene terephthalate), polystyrene and paper, including polyethylene-coated paper and polypropylene-coated paper can also be used. Any coating method such as dip-coating, brushing rolling, spraying, or the like, may be used to apply the conductive layer to the support.

The conductive coating composition generally comprises the conductive polymer and the hydrolyzed tetraethyl orthosilicate mixed in a water base. Various addenda may be added to the conductive polymer-tetraethyl orthosilicate containing compositions such as polymeric extenders, such as poly(vinyl alcohol), and others such as clays, talcs, and calcium carbonates and the like, and a wide variety of pigments, such as $BaSO_4$, $SiO_2$, and the like.

The conductive layer can generally be of any thickness. In the preferred embodiment, however, the conductive layer is about 0.1 micron.

The overcoat for the conductive layer can comprise water-soluble or water-dispersible polymeric compositions. The term "water-soluble polymer" as used throughout the specification, is defined as a polymer which has the solubility in water at 25° C to the extent that at least 5 parts by weight of the polymer are soluble in 95 parts by weight of water.

Although it is preferred to overcoat the conductive layer directly with the aqueous-based layer, various barrier layers and the like which are water-permeable may be used intermediate to the conductive layer and the overcoat layer.

In a preferred embodiment of this invention, the overcoat is an aqueous solution or dispersion of an electrically insulating polymer. The overcoat layer should have an electrical resistivity of greater than $10^{10}$ ohm/sq. In electrophotographic imaging processes, for example, the conductive layer is overcoated with an aqueous solution or dispersion of an electrically insulating polymer and a photoconductor. The element will accept and retain an electrostatic charge in the absence of actinic radiation. In use, the surface of the element is charged in the dark to a uniform potential and exposed to an imagewise pattern of actinic radiation which selectively reduces the surface potential to produce a charge pattern corresponding to the imagewise radiation pattern. The resultant charge pattern, or electrostatic latent image, can be developed by contacting it with suitably charged toner particles which adhere in accordance with the charge pattern, or it may be transferred to another insulating surface upon which it is developed. The particles can then be fused or fixed to the surface by known means such as heat or they may be transferred to another surface to which they may be similarly fixed to produce a permanent reproduction of the radiation pattern. It is, of course, necessary in this process that the conductive layer not permeate into the insulating layer and that any material added to the conductive layer not be chemically active. Any permeation of the conductive layer to the insulating layer causes charge leakage to the insulating layer causing a non-uniform image. If the crosslinking agent for the conductive polymer is chemically active so as to interfere with the sensitometric properties of the layer, a well-defined image cannot be obtained.

Examples of suitable insulating polymers useful herein are poly(vinyl acetals) such as poly(vinyl butyral), co(polyvinyl acetate-crotonic acid), poly(vinyl acetate), poly(vinyl trifluoroacetate), poly(vinyl heptafluorobutyrate), and the like. A list of useful insulating polymers can be found in *Research Disclosure*, May, 1973, publication 10938, page 63.

The thickness of the insulating layer may be varied greatly, but is generally from about 0.1 micron to about 20 microns. The resulting layer can generally include various addenda, including pigments such as $BaSO_4$, $CaCO_3$, $SiO_2$, ZnO, $TiO_2$, and the like.

The elements of this invention can be used in a variety of photographic processes in addition to the electrophotographic process described above. The conductive layers may be used as hard antistatic layers for silver halide photographic films, silver halide emulsion-coated photographic papers, and in dry-silver photographic papers. As the hydrolyzed tetraethyl orthosilicate is not chemically active, good results are obtained in all of these processes.

The following examples are included for a further understanding of the invention.

Example 1

A solution of hydrolyzed tetraethyl orthosilicate was prepared by mixing 10 ml. of a solution of 5 ml. of concentrated hydrochloric acid in 245 ml. of water and 15 ml. of tetraethyl orthosilicate [$(C_2H_5O)_4Si$]. The mixture turned cloudy and then cleared. When the mixture was clear, 20 ml. of water and 105 ml. of tetraethyl orthosilicte were slowly added to the mixture with the aid of mechanical agitation.

To 1.5 g. of the above hydrolyzed tetraethylorthosilicate solution and 17.5 g. of water was added 1 g. of Calgon conductive polymer PCL-7091 having the formula:

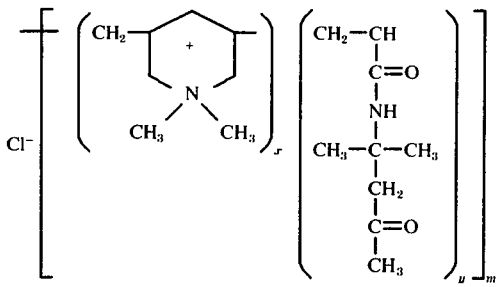

wherein $x$ is 90 mole percent and $y$ is 10 mole percent and $m$ is at least 2 and sufficient to realize a weight average molecular weight of 532,000 (units polydextran equivalent molecular weight).

A 0.002 inch wet thickness coating of the above mixture was coated on a poly(ethylene terephthalate) film support subbed with a vinylidene chloride (80 mole %), acrylonitrile (14 mole %), acrylic acid (6 mole %) terpolymer. After drying for 5 minutes in an oven at 105° C, the conducting layer appeared to be substantially water-insoluble, was flexible, and non-tacky.

A 0.002 inch wet thickness coating of a 20% aqueous solution of a polyvinylacetate-crotonic acid copolymer (Gelva $C_5V_{10}$) was then coated over the above conductive layer. Upon drying at 60° C, curing for 5 minutes at 105° C and reequilibrating at 50% relative humidity, the element was able to hold 900 volts when subjected to a charge-holding test. In the charge-holding test, the sample is charged to approximately 900 volts with a negative grid-controlled corona. The sample is removed from the charger and immediately placed directly under an electrometer probe attached to a Monroe electrometer. The voltage is recorded as a function of time for about 15 seconds. The maximum voltage is taken as the charge-holding value. This was compared to a similar element prepared using a vacuum deposited non-migratory nickel-conducting layer in the place of the conductive layer of this invention. The control element held 960 volts, indicating the element of this invention had a minimum of migration from the conductive layer to the insulating layer.

Example 2

This is a comparative example. An element similar to that described in Example 1 was made with the exception that no hydrolyzed tetraethyl orthosilicate was used as a crosslinking agent. This element was able to hold only 230 volts when subjected to the test of Example 1.

Example 3

This is a comparative example. Samples of the conductive polymer of Example 1 were crosslinked with conventional crosslinking agents such as hydrazine, glyoxal, chromium trioxide and melamine formaldehyde condensate (Verset 654-4). All of these crosslinking agents were either toxic, slow in crosslinking the polymer, had poor abrasion-resistance or high photoactivity. For example, chromium trioxide produced a highly colored film which was poorly crosslinking, while the Verset, glyoxal and hydrazine crosslinking agents exhibited high photoactivity.

Example 4

A conductive polymer was formed by adding 625 g. $P_4O_{10}$ and 520 g. 2-hydroxyethymethacrylate with 3 g. dinitrobenzene, 4,500cc. toluene, 1,000cc. methylene chloride and 2,000cc. distilled water in a flask. The reaction was allowed to continue overnight at 5° to 10° C, with stirring. After decanting the upper toluene layer, and adding 2,000cc. of distilled water over a period of one hour, the solid was dissolved and the reaction mixture was poured into a dropping funnel to separate the water and toluene layers. The filtered water layer was passed through two jacketed condensers. A slight vacuum was applied at the top of the condenser to remove any residual solvent. The material collected at the bottom was washed with one liter of methylene chloride. After separation of the layers, the water layer was treated with decolorizing carbon and filtered.

The reaction product was polymerized by placing 5,000 g. of a 30% solids water solution of 2-methacryoyloxyethylphosphoric acid monomer, as prepared above, in a reactor with 2,000 g. of formic acid, 10 g. of $K_2S_2O_8$, 10 g. of $K_2S_2O_5$ and 1 g. of $FeCl_2$. The reactor was filled with nitrogen and heated to 30° C with stirring. The polymerization continued for 16 hours.

To 9 g. of 5% aqueous solution of the above polymer was mixed 1 g. of the hydrolyzed tetraethyl orthosilicate solution described in Example 1. The composition was coated at 0.002 inch wet thickness on the subbed poly(ethylene terephthalate) film support described in Example 1. After drying and curing for 5 minutes at 105° C, the layer was substantially water-insoluble. After equilibration to 20% relative humidity, the surface resistivity of the conductive layer was measured was measured to be $8.7 \times 10^8$ ohm/sq. The layer was abrasion-resistant, flexible and non-tacky.

A similar conductive layer was formed with the exception that no hydrolyzed tetraethyl orthosilicate was used. The resulting layer was soft, easily abraded, and water-soluble. The surface resistivity of the layer at 20% relative humidity was measured to be $5.6 \times 10^7$ ohm/sq.

Example 5

A solution comprising 2.0 g. of polymer having the formula:

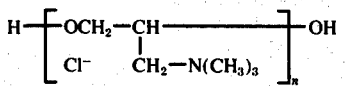

where $n$ is from 5-2000 (Nalco 61J16 conducting polymer), 1.5 Grams of the hydrolyzed tetraethyl orthosilicate solution of Example 1 and 11.5 g. of water was coated at 0.002 inch wet thickness on subbed poly(ethylene terephthalate) film support, dried at 60° C and cured for 5 minutes at 105° C. The element was found to have a surface resistivity of $1.6 \times 10^8$ ohm/sq. at 20% relative humidity and exhibited only very slight water solubility.

The invention has been described in detail with particular reference to certain preferred embodiments thereof, but it will be understood that variations and modifications can be effected within the spirit and scope of the invention.

I claim:

1. A photographic element comprising a conductive layer comprising a conductive polymer having an electrical resistivity of $1\times10^{10}$ ohm/sq. or lower crosslinked with hydrolyzed tetraethyl orthosilicate through an

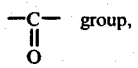

and having on the conductive layer a silver halide emulsion layer.

2. An electrophotographic element comprising a support having thereon a conductive layer comprising a conductive polymer having an electrical resistivity of $1\times10^{10}$ ohm/sq. or lower crosslinked with hydrolyzed tetraethyl orthosilicate through an OH or

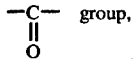

said conductive layer having thereon an aqueous-based coating comprising an insulating polymer and a photoconductor.

3. The electrophotographic element of claim 2 wherein the aqueous-baseed coating has an electrical resistance of at least $10^{10}$ ohm/sq. at room temperature.

4. The electrophotographic element of claim 2 wherein the weight ratio of conductive polymer to hydrolyzed tetraethyl orthosilicate is from 1:2 to 9:1.

5. The electrophotographic element of claim 2 wherein the conductive polymer is poly[N-methyl-N-(β-propionamido)-3,5-methylene piperidinium chloride].

6. The electrophotographic element of claim 2 wherein the conductive polymer is the reaction product of β-hydroxyethyl methacrylate with $P_2O_5$.

7. The electrophotographic element of claim 2 wherein the conductive polymer has the formula:

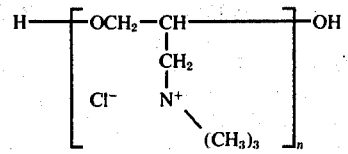

wherein $n$ is an integer of from 5 to 2000.

8. The electrophotographic element of claim 2 wherein the overcoat layer is coated onto the conductive layer in an aqueous solution or dispersion.

9. The electrophotographic element of claim 2 wherein the overcoat layer comprises poly(vinylacetal).

10. The electrophotographic element of claim 9 wherein the poly(vinylacetal) is poly(vinylbutyral).

11. The electrophotographic element of claim 9 wherein the poly(vinylacetal) is poly(vinylacetate).

12. The electrophotographic element of claim 2 wherein the overcoat layer comprises poly-co-(vinylacetatecrotonic acid).

13. The process of forming an electrophotographic element comprising coating a support with a first layer comprising a conductive polymer having an electrical resistivity of $1\times10^{10}$ ohm/sq. or lower which is crosslinked with hydrolyzed tetraethyl orthosilicate through an OH or

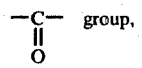

and overcoating said first layer with a second layer comprising an aqueous solution or dispersion of an insulting polymer and a photoconductor.

14. The process of claim 13 wherein the weight ratio of conductive polymer to hydrolyzed tetraethyl orthosilicate is from 1:2 to 9:1.

15. The process of claim 13 wherein the conductive polymer is poly[N-methyl-(β-propionamido)-3,5-methylene piperidinium chloride].

16. The process of claim 13 wherein the conductive polymer is the reaction product of β-hydroxyethyl methacrylate with $P_2O_5$.

17. The process of claim 13 wherein the conductive polymer has the formula:

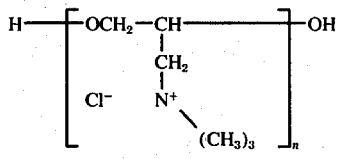

wherein $n$ is an integer of from 5 to 2000.

18. The process of claim 13 wherein the overcoat layer comprises poly(vinylacetal).

19. The process of claim 18 wherein the poly(vinyl acetal) is poly(vinylbutyral).

20. The process of claim 18 wherein the poly(vinyl acetal) is poly(vinylacetate).

21. The process of claim 13 wherein the overcoat layer comprises poly-co-(vinylacetate-crotonic acid).

22. The process of claim 13 wherein the thickness of the overcoat layer is from about 0.1 micron to about 20 microns.

23. An electrographic element comprising a support having thereon a conductive layer comprising a conductive polymer having an electrical resistivity of $1\times10^{10}$ ohm/sq. or lower crosslinked with hydrolyzed tetraethyl orthosilicate through an OH $$-\underset{\underset{O}{\|}}{C}-$$ group.

24. An electrophotographic element consisting essentially of a support having thereon a conductive layer comprising a conductive polymer having an electrical resistivity of $1\times10^{10}$ ohm/sq. or lower crosslinked with hydrolyzed tetraethyl orthosilicate through an OH $$-\underset{\underset{O}{\|}}{C}-$$ group, said conductive layer having thereon an aqueous based coating comprising an insulating polymer and a photoconductor.

* * * * *